US005769767A

United States Patent [19]

Hochberg et al.

[11] Patent Number: 5,769,767

[45] Date of Patent: Jun. 23, 1998

[54] EXERCISE DEVICE

[76] Inventors: Marvin Hochberg, 463 Summit Ave., Cedarhurst, N.Y. 11516; Frank Viggiano, 119 Hampshire Rd., Great Neck, N.Y. 11023-1437

[21] Appl. No.: 835,330

[22] Filed: Apr. 7, 1997

[51] Int. Cl.[6] ..... A63B 21/068

[52] U.S. Cl. ..... 482/142; 482/96

[58] Field of Search ..... 482/142, 96, 148

[56] References Cited

U.S. PATENT DOCUMENTS 3,378,359 4/1968 Kupchinski ..... 482/142

*Primary Examiner*—Lynne A. Reichard
*Attorney, Agent, or Firm*—Michael I. Kroll

[57] ABSTRACT

An exercise device (12) which comprises two body support members (14). Components (16) are for pivotally interconnecting abutting ends of the two body support members (14) together. Four legs (18) are provided. A facility (20) is for pivotally attaching upper ends of two of the legs (18) intermediately between two opposite sides of each body support member (14). Two flexible U-shaped braces (22) are also provided. A structure (24) is for securing upper ends of each flexible U-shaped brace (22) between lower ends of one leg (18) on the first body support member (14) and one leg (18) on the second body support member (14) on the same sides thereof. The two flexible U-shaped braces (22) will support the legs (18) upon a floor (26), to allow the two body support members (14) to tilt in multiple positions to allow a person on the two body support members (14) to exercise thereon.

22 Claims, 11 Drawing Sheets

EXERCISE DEVICE

BACKGROUND OF THE INVENTION

1. Field of the Invention

The instant invention relates generally to exercising equipment and more specifically it relates to an exercise device. The exercise device is similar to a chaise lounge and capable of tilting to multiple operative positions, so that a person sitting thereon in a generally prone position can exercise.

2. Description of the Prior Art

Numerous exercising equipment have been provided in prior art that are adapted to be used by people sitting on the exercising equipment to strengthen and develop their muscles. For example, U.S. Pat. No. 2,938,572 to Solloway et al. is illustrative of such prior art. While this unit may be suitable for the particular purpose to which it addresses, it would not be as suitable for the purposes of the present invention as heretofore described.

In combination, a body supporting frame consisting of two sections pivotally interconnected at the center of the frame. Studs downwardly project from the side edges of the two sections intermediate the ends thereof. Two U-shaped supporting brackets are provided. Each bracket includes a base member and legs rising from the ends thereof. The upper ends of the legs of each bracket are pivotally mounted on the studs at one side edge of the frame. The two frame sections have freedom of relative swinging movements on their pivotal interconnection and on the pivotal connection with the upper ends of the legs.

SUMMARY OF THE INVENTION

A primary object of the present invention is to provide an exercise device that will overcome the shortcomings of the prior art devices.

Another object is to provide an exercise device that is similar to a chaise lounge, but is capable of tilting to multiple operative positions to allow a person sitting thereon in a generally prone position to exercise.

An additional object is to provide an exercise device that is lightweight and collapsible, so that it is capable of being folded up into a compact condition to be stored or transported, while it also can be changed into a beach chair when the need arises.

A further object is to provide an exercise device that is simple and easy to use.

A still further object is to provide an exercise device that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein;

FIG. 1 is a top perspective view of the instant invention in a first position with the center tilted down.

FIG. 1*a* is a side view taken in the direction of arrow 1*a* in FIG. 1.

FIG. 2 is a bottom perspective view of the invention in a second position with the center straight.

FIG. 2*a* is a side view taken in the direction of arrow 2*a* in FIG. 2.

FIG. 3 is a top perspective view of the instant invention in a third position with the center tilted up.

FIG. 3*a* is a side view taken in the direction of arrow 3*a* in FIG. 3.

Similar reference characters denote corresponding features consistently throughout the attached drawings.

DETAILED DESCRIPTION OF THE PREFERRED EMBODIMENTS

Figure 1:
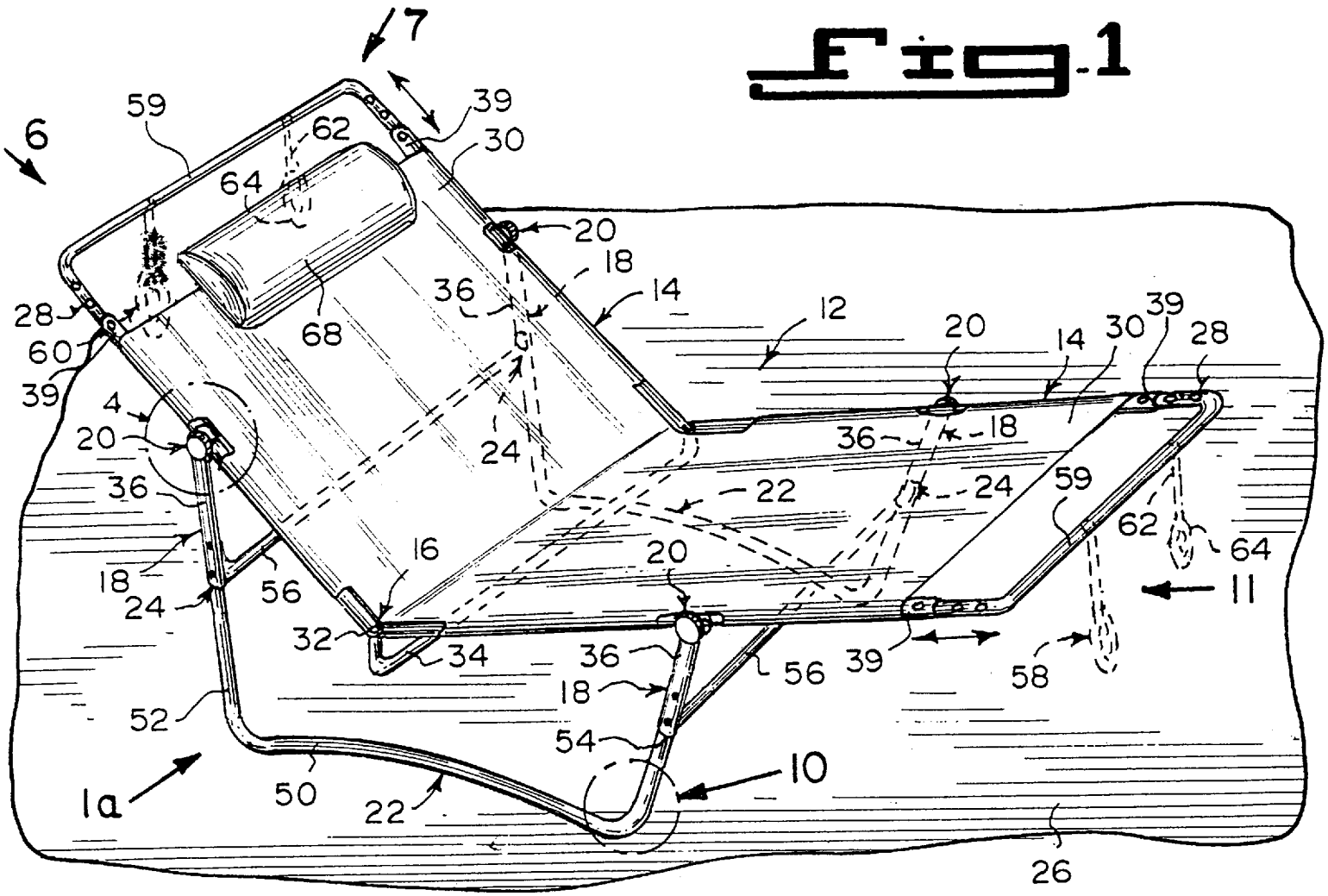

Turning now descriptively to the drawings, in which similar reference characters denote similar elements throughout the several views, FIGS. 1 through 11 illustrate an exercise device 12 which comprises two body support members 14. Components 16 are for pivotally interconnecting abutting ends of the two body support members 14 together. Four legs 18 are provided. A facility 20 is for pivotally attaching upper ends of two of the legs 18 intermediately between two opposite sides of each body support member 14. Two flexible U-shaped braces 22 are also provided. A structure 24 is for securing upper ends of each flexible U-shaped brace 22 between lower ends of one leg 18 on the first body support member 14, and one leg 18 on the second body support member 14 on the same sides thereof. The two flexible U-shaped braces 22 will support the legs 18 upon a floor 26, to allow the two body support members 14 to tilt in multiple positions, to allow a person on the two body support members 14 to exercise thereon.

Each body support member 14 includes a U-shaped tubular frame 28 and a covering 30 extending over and affixed to the U-shaped tubular frame 28. The pivotally interconnecting components 16 consist of a pair of pivot fasteners 32 connected to the abutting ends of the two body support members 14. An elongated U-shaped cross member 34 has opposite upturned arms connected to the pivot fasteners 32.

Figure 5:
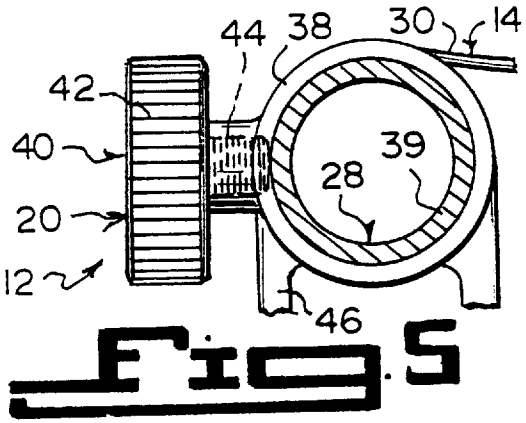
FIG. 5 is a cross sectional view taken along line 5—5 in FIG. 4.
Figure 4:
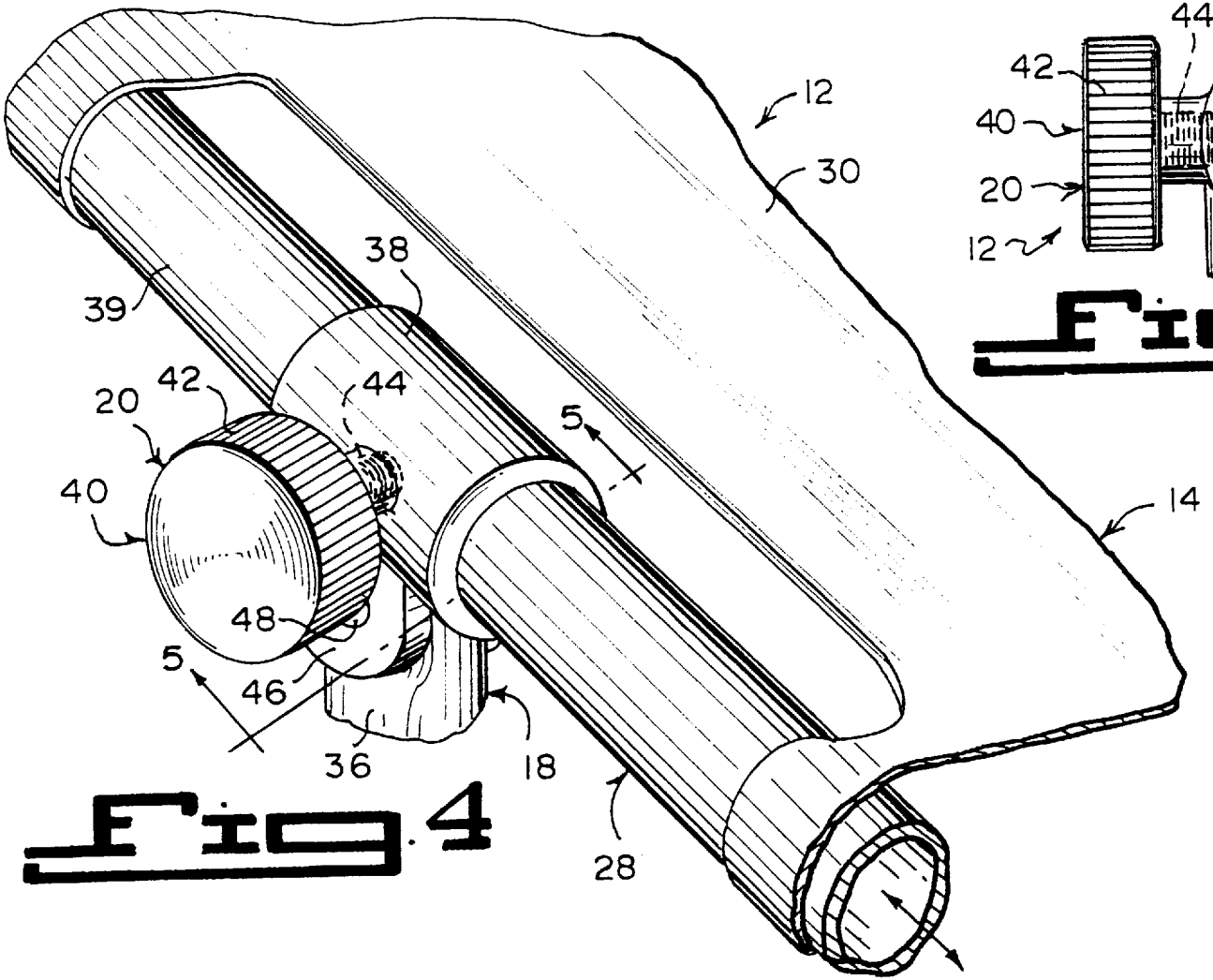
FIG. 4 is an enlarged perspective view showing one pivotally attaching facility in greater detail, as indicated by arrow 4 in FIG. 1.

Each leg 18 is a tubular member 36. Each pivotally attaching facility 20, as best seen in FIGS. 4 and 5, comprises a collar 38 which slides on a side portion 39 of the U-shaped tubular frame 28 of one body support member 14. A setscrew 40 having a large knurled head 42 and a threaded shank 44 extends through the collar 38, to retain the collar 38 in a stationary position on the side portion 39. A yoke 46 extends downwardly from the collar 38. A pivot pin 48 extends through the yoke 46 and the upper end of one leg 18.

Each flexible U-shaped brace 22 includes a cylindrical arched base 50 and two cylindrical stanchions 52, in which each said cylindrical stanchion 52 is formed on an opposite end of the cylindrical arched base 50. Each securing structure 24 is a socket 54 in the lower end of the leg 18, so that one cylindrical stanchion 52 of one flexible U-shaped brace 22 can be plugged into the socket 54.

The exercise device 12 further includes a pair of crossbars 56, in which the first crossbar 56 extends transversely between the two legs 18 on the first body support member 14. The second crossbar 56 extends transversely between the two legs on the second body support member 14, to add stability to the legs 18.

As shown in FIG. 1, a pair of footgrips 58 are attached to a transverse end portion 59 of the first U-shaped tubular frame 28. A pair of handgrips 60 are attached to a transverse end portion 59 of the second U-shaped tubular frame 28.

Figure 3:
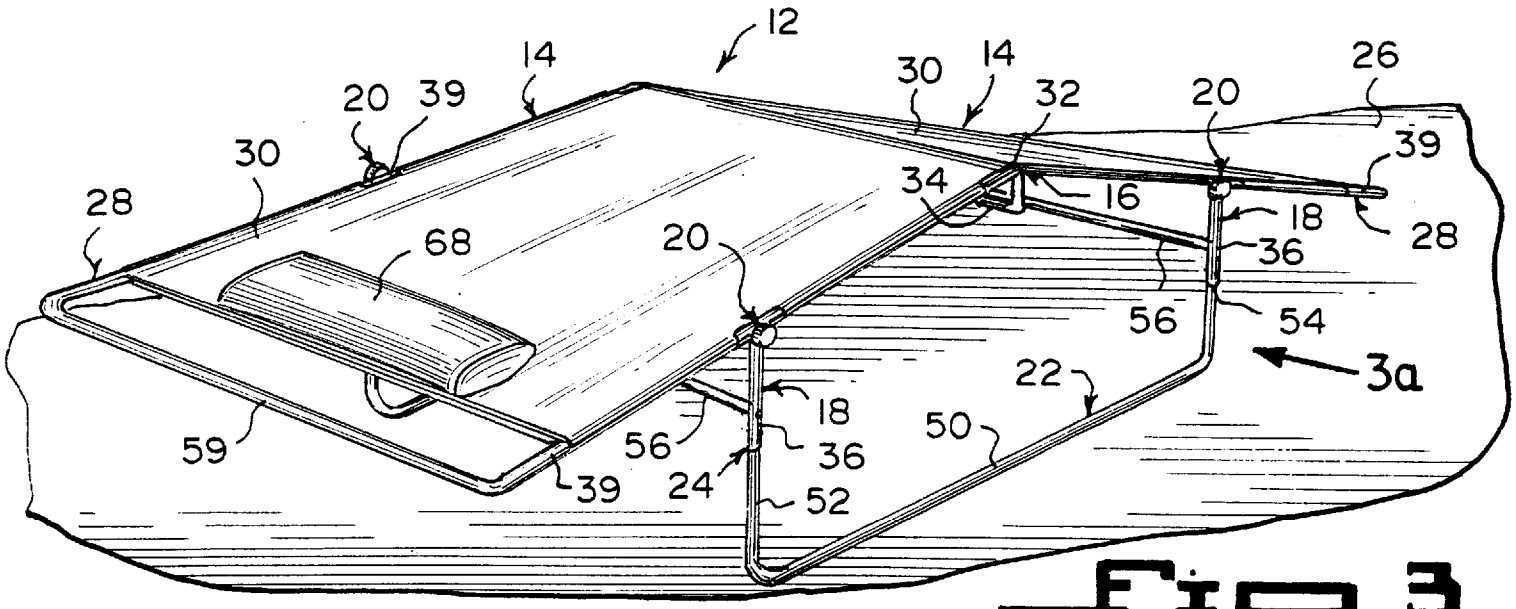
Figures 6, 7:
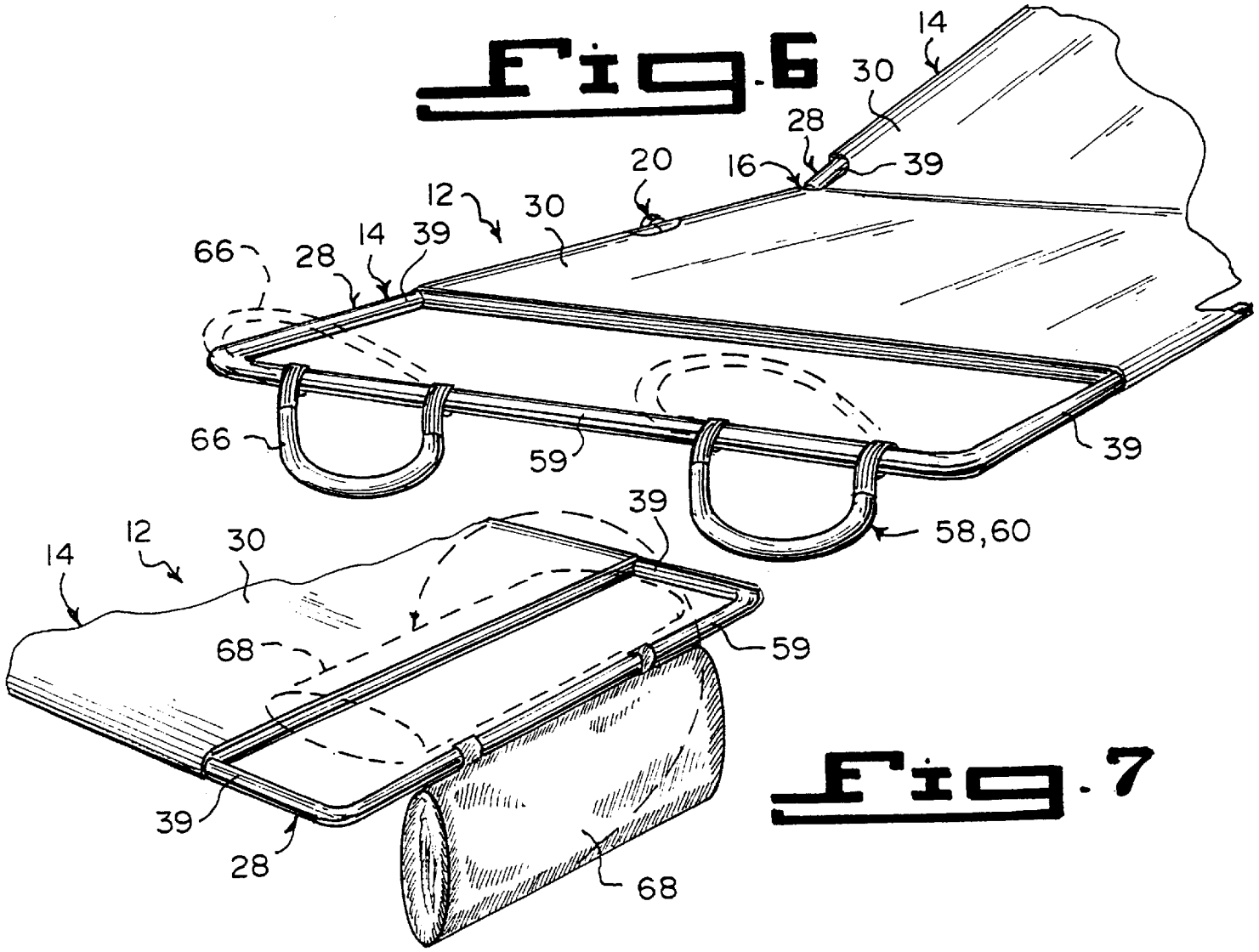
FIG. 6 is a top perspective view taken in the direction of arrow 6 in FIG. 1, with parts broken away showing the handgrips or foot grips being U-shaped bands.
FIG. 7 is a top perspective view taken in the direction of arrow 7 in FIG. 1, with parts broken away showing a pivotal pillow on the transverse portion of the U-shaped tubular frame.

Each footgrip 58 and handgrip 60 consists of a strap 62, having a first end extending from the transverse end portion 59 of one U-shaped tubular frame 28. A ring 64 is attached to a second end of the strap 62. Each footgrip 58 and handgrip 60 can also be a U-shaped band 66, affixed to the transverse end portion 59 of one U-shaped tubular frame 28, as shown in FIG. 6. A pillow 68, as shown in FIGS. 1, 3 and 7, is on one body support member 14, so that a head of the person can rest upon the pillow 68 while exercising.

Figure 11:
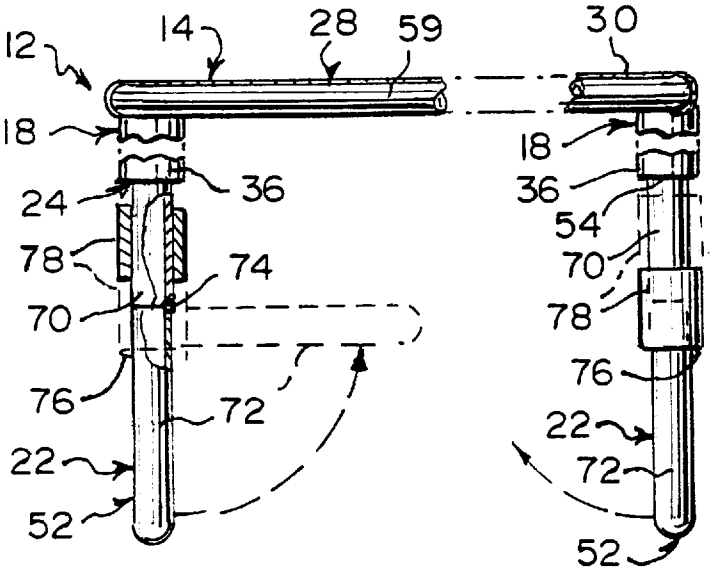
FIG. 11 is an end view taken in the direction of arrow 11 in FIG. 1, with parts broken away and in section showing two foldable U-shaped braces.
Figure 10:
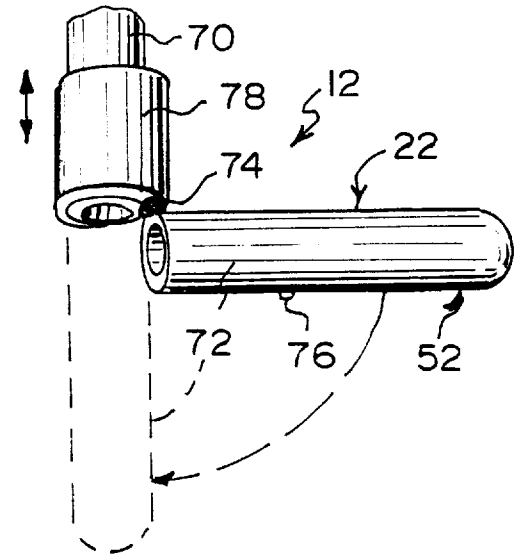
FIG. 10 is an enlarged perspective view of the area in FIG. 1, as indicated by arrow 10, showing one foldable U-shaped brace.

In FIGS. 10 and 11, each flexible U-shaped brace 22 is foldable and includes each cylindrical stanchion 52 being split into an upper segment 70 and a lower segment 72. An inner hinge 74 is between the upper segment 70 and the lower segment 72, so that the lower segment 72 can pivot up under the body support member 14. A stop 76 is on the lower segment 72. A sleeve 78 is carried on the upper segment 70 in a sliding manner. When the lower segment 72 pivots down, the sleeve 78 will slide down to the stop 76 on the lower segment 72 and over the inner hinge 74, to keep the cylindrical stanchion 52 in a straight stationary position.

FIG. 1 shows an optional feature, wherein the transverse end portions 59 are telescopic with the side portions 39 of the U-shaped tubular frames 28 of the body support members 14. This allows adjustment of the overall length thereof, to accommodate different sized people exercising on the exercise device 12.

Figure 8:
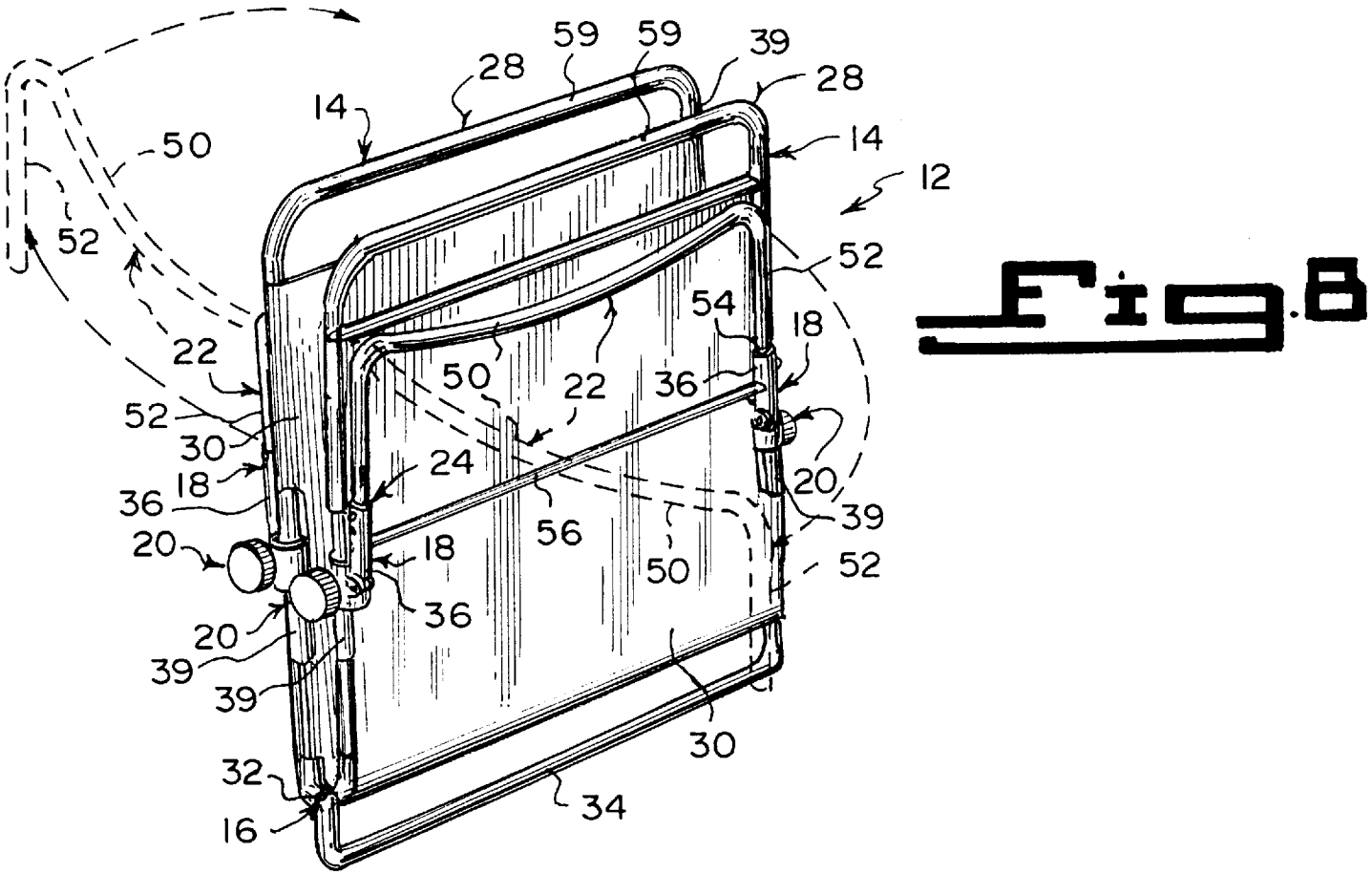
FIG. 8 is a perspective view showing the instant invention in a folded or collapsed position to be stored or transported.
Figure 9:
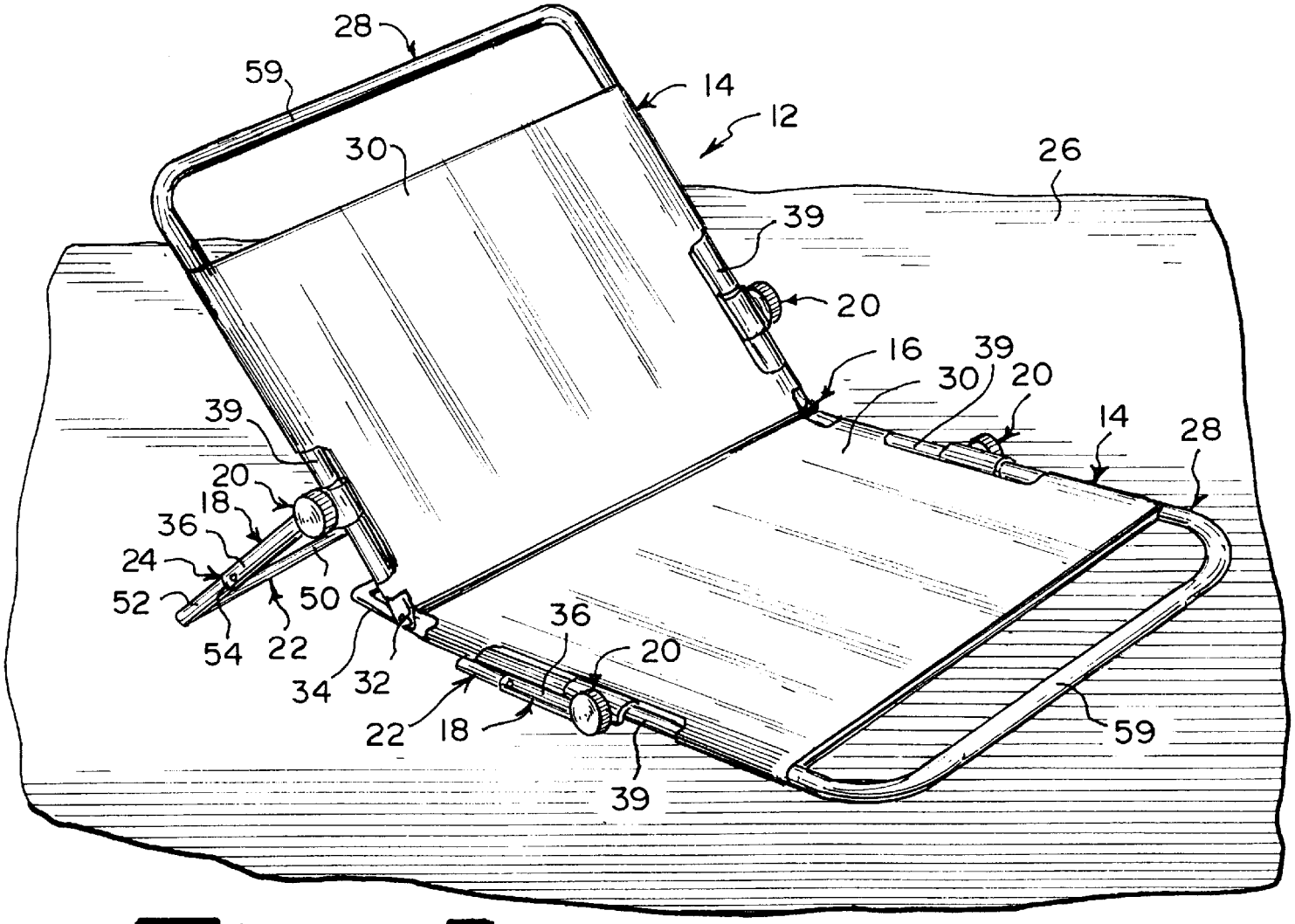
FIG. 9 is a perspective view showing the instant invention positioned on the floor as a beach chair.

The upper ends of the cylindrical stanchions 52 are removably received within the sockets 54 and this construction permits the first cylindrical stanchion 52 to be disconnected from it's respective socket 54 when desired, to permit the second cylindrical stanchion 52 to swivel within it's respective socket 54, to allow the first cylindrical stanchion 52 to plug into an opposite socket 54. This allows the exercise device 12 to assume a folded or collapsed position, as shown in FIG. 8. In FIG. 9, one body support member 14 is shown resting on the floor 26, while the other body support member 14 is supported in an inclined position by the flexible U-shaped brace 22 extending transversely.

Figure 1A:
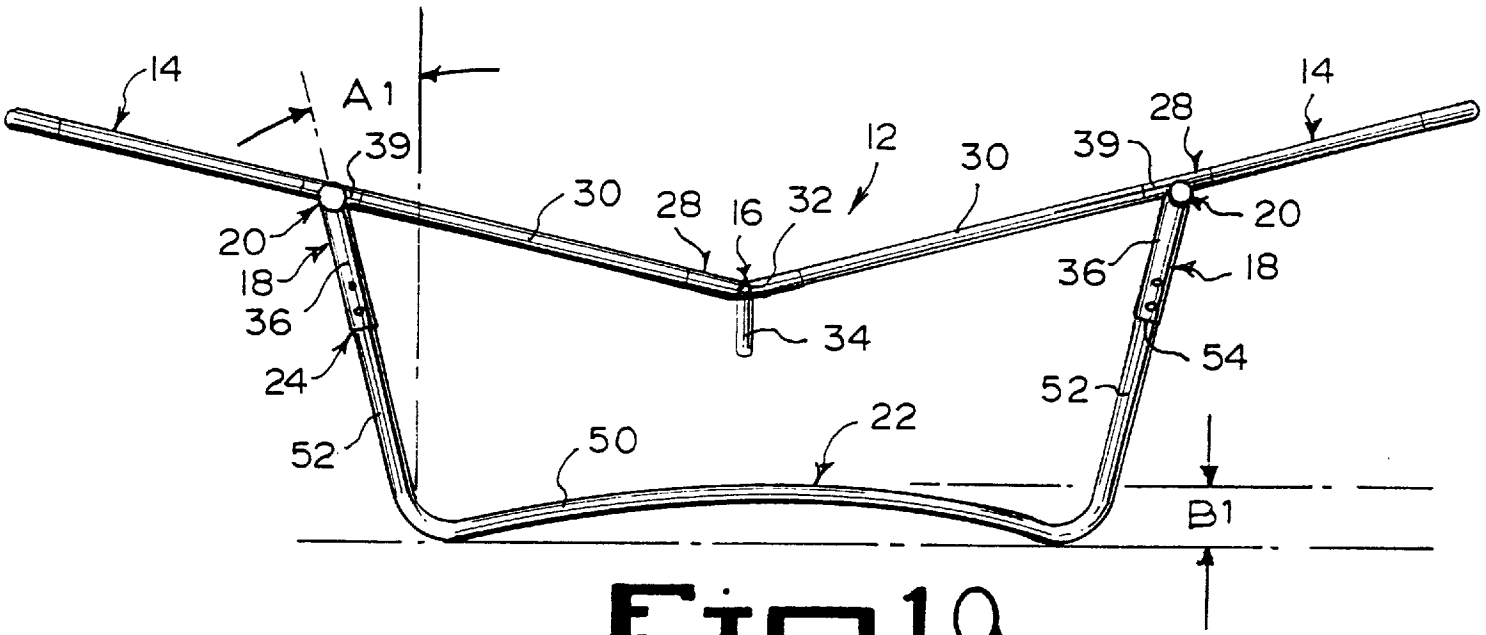
Figure 2:
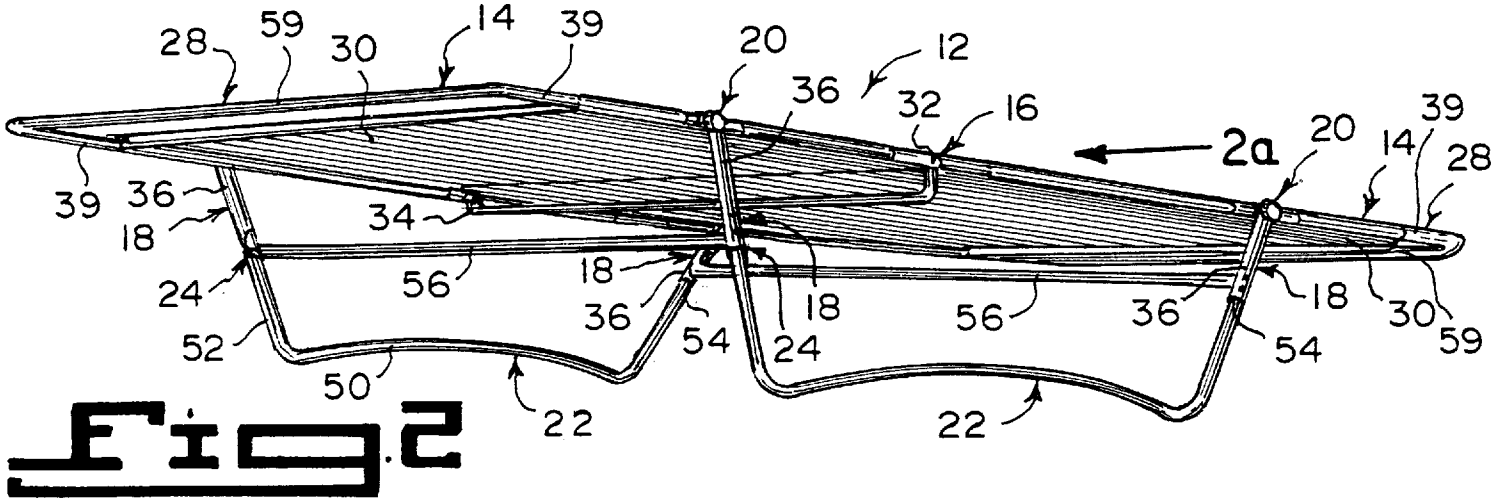
Figure 2A:
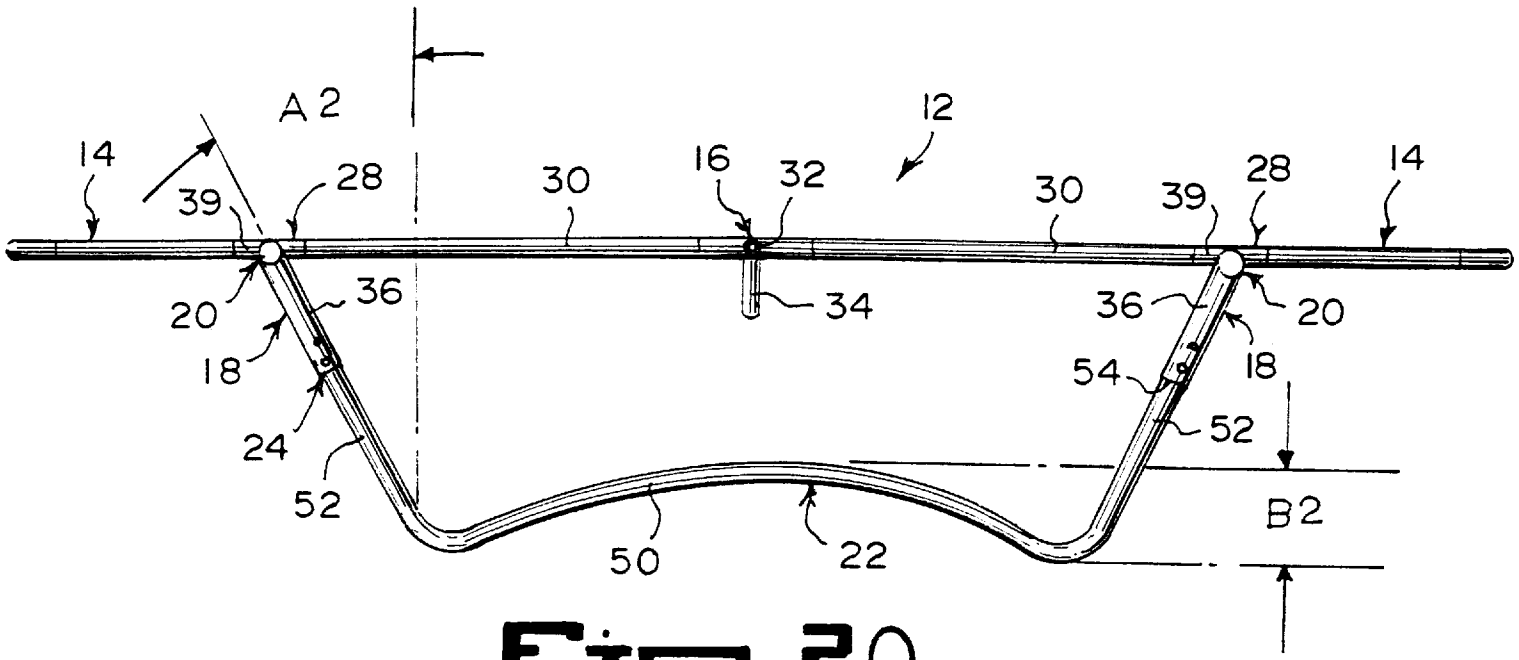
Figure 3A:
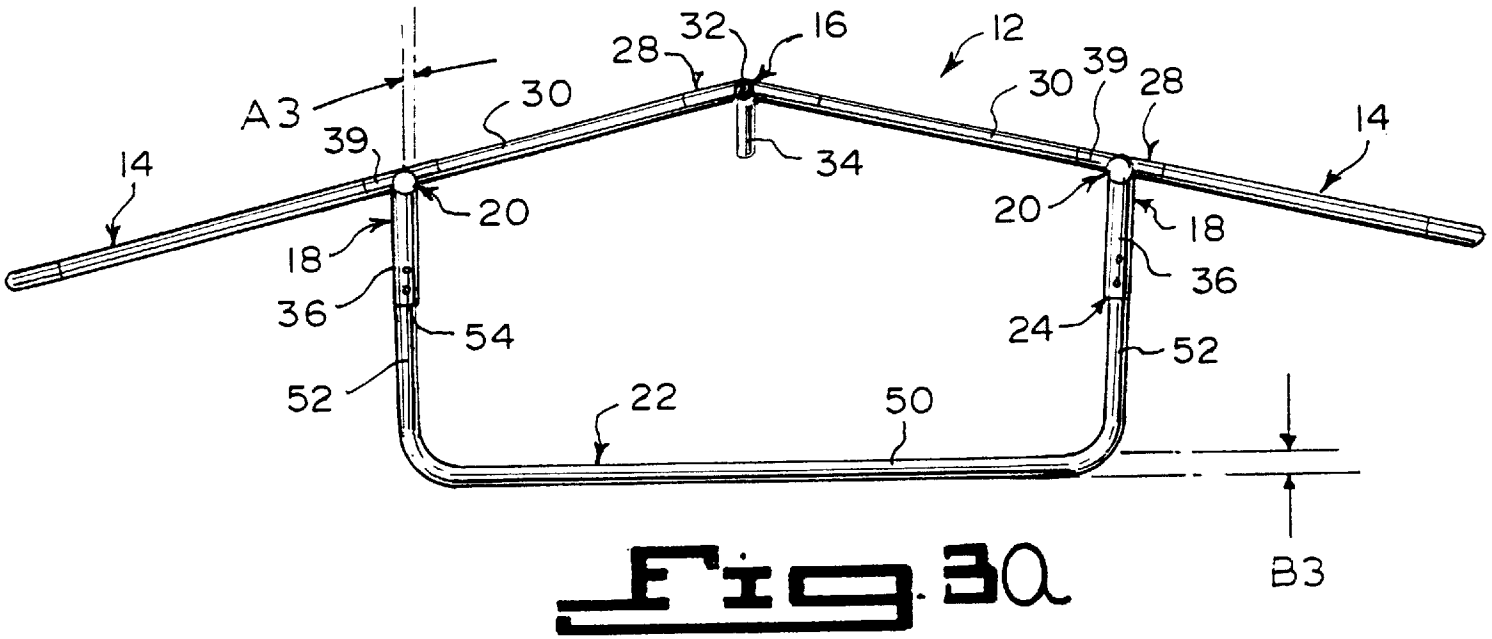

When the exercise device 12 is in the first position with the center tilted down, as shown in FIG. 1*a*, each leg 18 and cylindrical stanchion 52 is set at an angle from the vertical as indicated by "A1", while the cylindrical arched base 50 is bowed at a height as indicated by "B1". When the exercise device 12 goes into the second position with the center straight, as shown in FIG. 2*a*, each leg 18 and cylindrical stanchion 52 is set at a greater angle from the vertical as indicated by "A2", while the cylindrical arched base 50 is bowed at a greater height as indicated by "B2". When the exercise device 12 goes into the third position with the center tilted up, as shown in FIG. 3*a*, each leg 18 and cylindrical stanchion 52 is set at a smaller angle from the vertical as indicated by "A3", while the cylindrical arched base 50 is bowed at a smaller height as indicated by "B3".

LIST OF REFERENCE NUMBERS

12 exercise device
14 body support member of 12
16 pivotally interconnecting component of 12
18 leg of 12
20 pivotally attaching facility of 12
22 flexible U-shaped brace
24 securing structure of 12
26 floor
28 U-shaped tubular frame of 14
30 covering of 14 on 28
32 pivot fastener of 16
34 elongated U-shaped cross member of 16
36 tubular member for 18
38 collar of 20
39 side portion of 28
40 setscrew of 20
42 large knurled head of 40
44 threaded shank of 40
46 yoke of 20
48 pivot pin of 20
50 cylindrical arched base of 22
52 cylindrical stanchion of 22
54 socket of 24
56 crossbar of 12
58 footgrip of 12
59 transverse end portion of 28
60 handgrip of 12
62 strap of 58 and 60
64 ring of 58 and 60
66 U-shaped band for 58 and 60
68 pillow of 12
70 upper segment of 52
72 lower segment of 52
74 inner hinge between 70 and 72
76 stop on 72
78 sleeve on 70

It will be understood that each of the elements described above, or two or more together may also find a useful application in other types of methods differing from the type described above.

While certain novel features of this invention have been shown and described are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by letters patent is set forth in the appended claims:

1. An exercise device which comprises:

a) two body support members, each including:
   i) a U-shaped tubular frame; and
   ii) a covering extending over and affixed to said U-shaped tubular frame;

b) means for pivotally interconnecting abutting ends of said two body support members together;

c) four legs;

d) means for pivotally attaching upper ends of two of said legs intermediately between two opposite sides of each said body support member, each pivotally attaching means including:
   i) a collar which slides on a side portion of said U-shaped tubular frame of one said body support member;
   ii) a setscrew having a large knurled head and a threaded shank extending through said collar, to retain said collar in a stationary position on said side portion;
   iii) a yoke extending downwardly from said collar; and
   iv) a pivot pin extending through said yoke and the upper end of one said leg;

e) two flexible U-shaped braces; and f) means for securing upper ends of each said flexible U-shaped brace between lower ends of one said leg on said first body support member and one said leg on said second body support member on the same sides thereof, so that said two flexible U-shaped braces will support said legs upon a floor, to allow said two body support members to tilt in multiple positions to allow a person on said body support members to exercise thereon.

2. An exercise device as recited in claim 1, wherein said pivotally interconnecting means includes:

a) a pair of pivot fasteners connected to the abutting ends of said two body support members; and b) an elongated U-shaped cross member having opposite upturned arms connected to said pivot fasteners.

3. An exercise device as recited in claim 2, wherein each said leg is a tubular member.

4. An exercise device as recited in claim 3, wherein each said flexible U-shaped brace includes:

a) a cylindrical arched base; and b) two cylindrical stanchions in which each said cylindrical stanchion is formed on an opposite end of said cylindrical arched base.

5. An exercise device as recited in claim 4, wherein each said securing means is a socket in the lower end of said leg, so that one said cylindrical stanchion of one said flexible U-shaped brace can be plugged into said socket.

6. An exercise device as recited in claim 5, further including a pair of crossbars, in which said first crossbar extends transversely between said two legs on said first body support member and said second crossbar extends transversely between said two legs on said second body support member, to add stability to said legs.

7. An exercise device as recited in claim 6, further including:

a) a pair of footgrips attached to a transverse end portion of said first U-shaped tubular frame; and b) a pair of handgrips attached to a transverse end portion of said second U-shaped tubular frame.

8. An exercise device as recited in claim 7, wherein each said footgrip and said handgrip includes:

a) a strap having a first end extending from said transverse end portion of one said U-shaped tubular frame; and b) a ring attached to a second end of said strap.

9. An exercise device as recited in claim 7, wherein each said footgrip and said handgrip is a U-shaped band affixed to said transverse end portion of one said U-shaped tubular frame.

10. An exercise device as recited in claim 7, further including a pillow on one said body support member, so that a head of the person can rest upon said pillow while exercising.

11. An exercise device as recited in claim 10, wherein each said flexible U-shaped brace is foldable and includes:

a) each said cylindrical stanchion being split into an upper segment and a lower segment;

b) an inner hinge between said upper segment and said lower segment, so that said lower segment can pivot up under said body support member;

c) a stop on said lower segment; and d) a sleeve carried on said upper segment in a sliding manner, so that when said lower segment pivots down, said sleeve will slide down to said stop on said lower segment and over said inner hinge to keep said cylindrical stanchion in a straight stationary position.

12. An exercise device as recited in claim 11, wherein said transverse end portions are telescopic with side portions of said U-shaped tubular frames of said body support members, so as to adjust the overall length thereof, to accommodate different sized people exercising on said exercise device.

13. An exercise device as recited in claim 1, wherein each said leg is a tubular member.

14. An exercise device as recited in claim 1, wherein each said flexible U-shaped brace includes:

a) a cylindrical arched base; and b) two cylindrical stanchions in which each said cylindrical stanchion is formed on an opposite end of said cylindrical arched base.

15. An exercise device as recited in claim 14, wherein each said securing means is a socket in the lower end of said leg, so that one said cylindrical stanchion of one said flexible U-shaped brace can be plugged into said socket.

16. An exercise device as recited in claim 14, wherein each said flexible U-shaped brace is foldable and includes:

a) each said cylindrical stanchion being split into an upper segment and a lower segment;

b) an inner hinge between said upper segment and said lower segment, so that said lower segment can pivot up under said body support member;

c) a stop on said lower segment; and d) a sleeve carried on said upper segment in a sliding manner, so that when said lower segment pivots down, said sleeve will slide down to said stop on said lower segment and over said inner hinge to keep said cylindrical stanchion in a straight stationary position.

17. An exercise device as recited in claim 1, further including a pair of crossbars, in which said first crossbar extends transversely between said two legs on said first body support member an d said second crossbar extends transversely between said two legs on said second body support member, to add stability to said legs.

18. An exercise device as recited in claim 1, further including:

a) a pair of footgrips attached to a transverse end portion of said first U-shaped tubular frame; and b) a pair of handgrips attached to a transverse end portion of said second U-shaped tubular frame.

19. An exercise device as recited in claim 18, wherein each said footgrip and said handgrip includes:

a) a strap having a first end extending from said transverse end portion of one said U-shaped tubular frame; and b) a ring attached to a second end of said strap.

20. An exercise device as recited in claim 18, wherein each said footgrip and said handgrip is a U-shaped band affixed to said transverse end portion of one said U-shaped tubular frame.

21. An exercise device as recited in claim 18, wherein said transverse end portions are telescopic with side portions of said U-shaped tubular frames of said body support members, so as to adjust the overall length thereof, to accommodate different sized people exercising on said exercise device.

22. An exercise device as recited in claim 1, further including a pillow on one said body support member, so that a head of the person can rest upon said pillow while exercising.

* * * * *